US010383205B2

(12) United States Patent
Lal et al.

(10) Patent No.: US 10,383,205 B2
(45) Date of Patent: Aug. 13, 2019

(54) WAFER-BASED CHARGED PARTICLE ACCELERATOR, WAFER COMPONENTS, METHODS, AND APPLICATIONS

(71) Applicant: CORNELL UNIVERSITY, Ithaca, NY (US)

(72) Inventors: Amit Lal, Ithaca, NY (US); Thomas Schenkel, San Francisco, CA (US); Arun Persaud, El Cerrito, CA (US); Qing Ji, Albany, CA (US); Peter Seidl, Oakland, CA (US); Will Waldron, Berkeley, CA (US); Serhan Ardanuc, Ithaca, NY (US); Vinaya Kumar Kadayra Basavarajappa, Ithaca, NY (US)

(73) Assignee: Cornell University, Ithaca, NY (US)

( * ) Notice: Subject to any disclaimer, the term of this patent is extended or adjusted under 35 U.S.C. 154(b) by 0 days.

(21) Appl. No.: 16/098,537

(22) PCT Filed: May 4, 2017

(86) PCT No.: PCT/US2017/031029
§ 371 (c)(1),
(2) Date: Nov. 2, 2018

(87) PCT Pub. No.: WO2017/192834
PCT Pub. Date: Nov. 9, 2017

(65) Prior Publication Data

US 2019/0159331 A1 May 23, 2019

Related U.S. Application Data

(60) Provisional application No. 62/331,614, filed on May 4, 2016.

(51) Int. Cl.
*H05H 7/02* (2006.01)
*H05H 7/22* (2006.01)
*H05H 9/04* (2006.01)

(52) U.S. Cl.
CPC ..... *H05H 7/22* (2013.01); *H05H 7/02* (2013.01); *H05H 9/04* (2013.01); *H05H 2007/025* (2013.01)

(58) Field of Classification Search
CPC .. H05H 7/22; H05H 7/02; H05H 9/04; H05H 2007/025
(Continued)

(56) References Cited

U.S. PATENT DOCUMENTS 5,086,256 A * 2/1992 Tokiguchi ..... H05H 7/02 250/423 R
5,825,140 A * 10/1998 Fujisawa ..... H05H 9/00 315/505
(Continued)

FOREIGN PATENT DOCUMENTS

JP 2016031849 3/2016
WO 2014123591 8/2014

OTHER PUBLICATIONS

International Search Report and Written Opinion for PCT Application No. PCT/US2017/031029 dated Jul. 31, 2017; Forms PCT/ISA/210 and PCT/ISA/237; 9 pages.

*Primary Examiner* — Don P Le
(74) *Attorney, Agent, or Firm* — Perkins Coie LLP

(57) ABSTRACT

A wafer-based charged particle accelerator includes a charged particle source and at least one RF charged particle accelerator wafer sub-assembly and a power supply coupled to the at least one RF charged particle accelerator wafer sub-assembly. The wafer-based charged particle accelerator may further include a beam current-sensor. The wafer-based charged particle accelerator may further include at least a
(Continued)

second RF charged particle accelerator wafer sub-assembly and at least one ESQ charged particle focusing wafer. Fabrication methods are disclosed for RF charged particle accelerator wafer sub-assemblies, ESQ charged particle focusing wafers, and the wafer-based charged particle accelerator.

5 Claims, 15 Drawing Sheets

(58) Field of Classification Search
USPC ..... 315/506
See application file for complete search history.

(56) References Cited

U.S. PATENT DOCUMENTS

| | | | | |
|---|---|---|---|---|
| 6,060,833 | A * | 5/2000 | Velazco | H05H 7/16 315/5.41 |
| 2004/0036032 | A1 | 2/2004 | Leung et al. | |
| 2007/0284527 | A1 | 12/2007 | Zani et al. | |
| 2011/0044418 | A1 | 2/2011 | Stubbers et al. | |
| 2016/0174355 | A1 * | 6/2016 | Lal | H05H 7/04 315/505 |

* cited by examiner

| $V_{quad}$ | a | a' | b | b' |
|---|---|---|---|---|
| ±100 V | 0.40 mm | -1.8 mrad | 3.52 mm | 62 mrad |
| 0 V | 1.95 mm | 29 mrad | 1.95 mm | 29 mrad |

WAFER-BASED CHARGED PARTICLE ACCELERATOR, WAFER COMPONENTS, METHODS, AND APPLICATIONS

RELATED APPLICATION DATA

The instant application claims priority to U.S. provisional application Ser. 62/331,614 filed May 4, 2016, the subject matter of which is incorporated by reference herein in its entirety.

GOVERNMENT SUPPORT

This invention was made with government support under Contract No. DE-AC02-05CH11231 awarded by the U.S. Department of Energy. The government has certain rights in this invention.

BACKGROUND

Aspects and embodiments of the invention most generally pertain to a charged particle accelerator apparatus, accelerator components, fabrication methods, and applications; more particularly to a wafer-based charged particle accelerator, radio-frequency (RF) charged particle accelerator wafers, RF charged particle accelerator wafer assemblies, and electrostatic quadrupole (ESQ) focusing wafers, manufacturing methods, and applications; most particularly to a multi-beam, wafer-based charged particle accelerator, RF and ESQ wafers and assemblies, and manufacturing methods, and applications. The described accelerator structure can revolutionize the cost, size, weight, and power consumption of charged particle accelerators. By having each component of the accelerator structure fabricated on a wafer like substrate, we aim to leverage batch fabrication capabilities of silicon and other substrates to reduce the need for traditional machining of metals. The same wafers, armed with integrated electronics for closed loop control of the accelerating and guiding electric fields will eliminate or greatly reduce electronics equipment away from the prime accelerator, thus reducing size weight and power of the overall accelerator. By using micromachining approaches to make small gaps, moderate voltages can be used to achieve substantial focusing effects on charged particles. The existence of miniature UHV (ultra-high vacuum) pumps that can also be lightweight attached to the system further enables the possibility of light weight and small MeV ($10^6$ electron volt) class accelerators. We envision accelerators that are vehicle- and even man-portable to provide charged particle beams for many applications for x-ray generation, neutron beam generation, and medical therapies, that are not possible due to the size, weight, and power of existing accelerators, which rely heavily on metal based machined structures.

Our approach is informed from the MEQALAC (Multiple-electrostatic-quadrupole array linear accelerator) approach that breaks one charged beam into several charged beams, in the context of scaling the amount of current an accelerator can accelerate. The MEQALAC development can be attributed to Alfred W. Maschke and colleagues at Brookhaven National Laboratory. Reference is made to U.S. Pat. No. 4,350,927 (Means For The Focusing And Acceleration Of Parallel Beams Of Charged Particles), Gammel et al., MEQALAC DEVELOPMENT AT BROOKHAVEN, Particle Accelerator Conference, Mar. 11-13, 1981 Shoreham Hotel, Washington, D.C., and Adams et al., DESCRIPTION OF THE M1 MEQALAC AND OPERATING RESULTS, Brookhaven National Laboratory, the subject matters of all of which are incorporated by reference in their entireties.

Many types of particle accelerators, including the original MEQALAC and others, require resonant cavities and high voltage sources, and have other characteristics some or all of which make them unwieldy in terms of size, cost, complexity, scalability, and other problematic attributes. In view of this, the inventors have recognized the need for, and advantages and benefits to be obtained from, improved performance, manufacturing processes, and operating architectures for more efficient, compact, and better performing MEQALAC-type charged particle accelerators, which are provided by the embodied invention disclosed herein.

Exemplary, non-limiting aspects and embodiments of the invention include MEMS- and microfabrication-, and laser micro-fabrication-based MEQALAC building blocks, methods for making RF and pulsed high voltage accelerator stage wafers and electro-static quadrupole (ESQ) ion and electron beam focusing stage wafers, internalized high-voltage sources, and applications. Process descriptions are provided for printed-circuit board (PCB)-based RF and pulsed high voltage accelerator and ESQ focusing wafers, silicon-based wafers, glass-based wafers, and 3D printed wafers. Internalized, triggered, high-voltage-providing circuitry is described.

SUMMARY

An aspect of the embodied invention is an RF charged particle accelerator wafer sub-assembly. In a non-limiting, exemplary embodiment the RF charged particle accelerator wafer sub-assembly includes a wafer having electrical isolation between at least a first and a second electrically conductive electrode, wherein at least the first and the second electrode are disposed on respective and opposing first and second sides of the wafer, and create an electric field, further wherein the wafer has one or more orifices through which a charged particle beam can travel, encountering the electric field generated by the at least first and second electrode, further wherein the second electrode is in the form of an RF resonator configured as either a) a thin film inductor in series with an air gap capacitor, or b) a coplanar waveguide resonator, so as to transform a low voltage on the first side of the substrate to a high voltage on the second side of the substrate; and RF voltage-generating electronics disposed on the substrate; and a power supply coupled to the at least one RF charged particle accelerator wafer sub-assembly. In a non-limiting, exemplary embodiment the RF charged particle accelerator wafer sub-assembly includes two RF charged particle accelerator wafer sub-assemblies, wherein the two RF charged particle accelerator wafers are linearly separated by a drift space having a drift distance, $\beta\lambda/2$ where $\lambda$ is the wavelength of electromagnetic waves in space at the accelerator frequency ($\lambda=c/v$, v is the accelerator RF frequency), and $\beta$ is the ratio of the speed of the charged particles to that of speed of light. The frequency v is the period of an oscillating voltage used to generate an accelerating electric field, further wherein the second side of a first one of the RF charged particle accelerator wafer is immediately adjacent an input end of the drift distance and the second side of the second one of the RF charged particle accelerator wafer is immediately adjacent an output end of the drift distance.

An aspect of the embodied invention is an ESQ (Electro-Static Quadrupole) charged particle beam focusing wafer. In a non-limiting, exemplary embodiment the ESQ charged particle beam focusing wafer comprises an electrically insulative wafer or planar substrate having at least one through-hole, each through-hole providing a beam path to focus the charged particle beam, each through-hole having at least four electrodes disposed at the inner perimeter of the through-hole, where each electrode further comprises one of a) exposed areas of the wafer covered by a conductive material in selected areas to form an electric field distribution to focus the charged particle beam, or b) conductive pillar-like structures coupled to insulating connectors, connected to the wafer. The conductive pillar-like structures may each one of a solid rod or a hollow cylinder.

An aspect of the embodied invention is a method for making an ESQ charged particle beam-focusing wafer. In a non-limiting, exemplary embodiment the method includes four electrical isolated electrodes arranged around a hole through the wafer for charged particles to pass through the wafer. For a focusing effect the sidewalls of these electrodes are biased at +V, −V, +V, −V; that is, alternating voltages. Normally the surfaces of the electrodes are shaped so that a linear electrical field near the center of the hole is achieved. A single ESQ wafer will provide focusing only in one direction orthogonal to the beam propagation and will defocus the beam in the other direction. Using two (or more) ESQs, a focusing effect in both directions can be achieved as previously identified in past accelerator work. On board electronics, integrated directly on the accelerator and ESQ wafers, or onto separate sensor wafers can be used to sense the charged particle beams. This feedback can be used to provide feedback to modify control voltages to provide active focusing and accelerations of the charged particle beams.

An aspect of the embodied invention is a wafer-based charged particle accelerator. In a non-limiting, exemplary embodiment the accelerator includes a charged particle source; at least one RF charged particle accelerator wafer sub-assembly comprising a wafer having electrical isolation between at least a first and a second electrically conductive electrode, wherein at least the first and the second electrode are disposed on respective and opposing first and second sides of the wafer, and create an electric field, further wherein the wafer has one or more orifices through which a charged particle beam can travel, encountering the electric field generated by the at least first and second electrode, further wherein the second electrode is in the form of an RF resonator configured as either a) a thin film inductor in series with an air gap capacitor, or b) a coplanar waveguide resonator, so as to transform a low voltage on the first side of the substrate to a high voltage on the second side of the substrate; and RF voltage-generating electronics disposed on the substrate; and a power supply coupled to the at least one RF charged particle accelerator wafer sub-assembly. The wafer-based charged particle accelerator may further comprise a beam current-sensor disposed in either a) a single RF wafer, or b) a separate wafer disposed in the drift space. The wafer-based charged particle accelerator may further comprise at least a second RF charged particle accelerator wafer sub-assembly; and at least one ESQ charged particle focusing wafer. The at least one ESQ charged particle focusing wafer may comprise an electrically insulative wafer or planar substrate having at least one through-hole, each through-hole providing a beam path to focus the charged particle beam, each through-hole having at least four electrodes disposed at the inner perimeter of the through-hole, where each electrode further comprises one of a) exposed areas of the wafer covered by a conductive material in selected areas to form an electric field distribution to focus the charged particle beam, and b) conductive pillar-like structures coupled to insulating connectors, connected to the wafer, linearly aligned with the RF charged particle accelerator wafer sub-assemblies. The conductive pillar-like structures may each be one of a solid rod or a hollow cylinder.

BRIEF DESCRIPTION OF THE FIGURES

FIG. 11A a coplanar waveguide resonator is formed on the accelerator wafer with orifices for the charged particle beams to pass through, such that nodes and antinodes of the voltage provide passive voltage magnification; FIG. 11B shows that a single wafer provides the electrodes to accelerate particles through it nodes and antinodes of the CPS resonator; FIG. 11C shows the conceptual sketch of the CPW resonator; FIG. 11D shows the physical implementation of a CPW resonator for the accelerator wafer; FIG. 11E Stacks of a CPW resonator and a ground wafer can also be used to form an accelerator section; FIG. 11F two accelerator structures can be stacked to form a complete accelerator sub-unit with ground potentials at input and output. One side of the wafer is grounded while the opposite side has a high voltage owing to the CPW resonance. Two such wafers are formed to form a drift space between the two wafers and the two active high voltages are in phase to not accelerate or deaccelerate in the drift space. The second wafer accelerates the beam again as the phase of the voltages have changed such as to provide an electric field in the desired direction of acceleration.

FIG. 16 shows a current trace of ions injected in a 3×3 beamlet pattern into the RF wafer stack, before the RF was turned on.

DETAILED DESCRIPTION OF EXEMPLARY, NON-LIMITING EMBODIMENTS OF THE INVENTION

Both Electrostatic Quadrupole (ESQ) wafers and RF wafers for a wafer-based charged particle accelerator include an insulating wafer substrate with one or more of insulated holes, holes with sidewall metal coatings, holes with partial sidewall metal coatings, metal-filled vias, as well as top and bottom patterning for routing of electrical signals and contact to sidewall metals or vias. Insulated substrates may include printed circuit boards (PCBs; e.g., FR4), glass with Through-Glass-Vias (TGVs), and silicon, as well as 3D printed structures.

Figure 1:
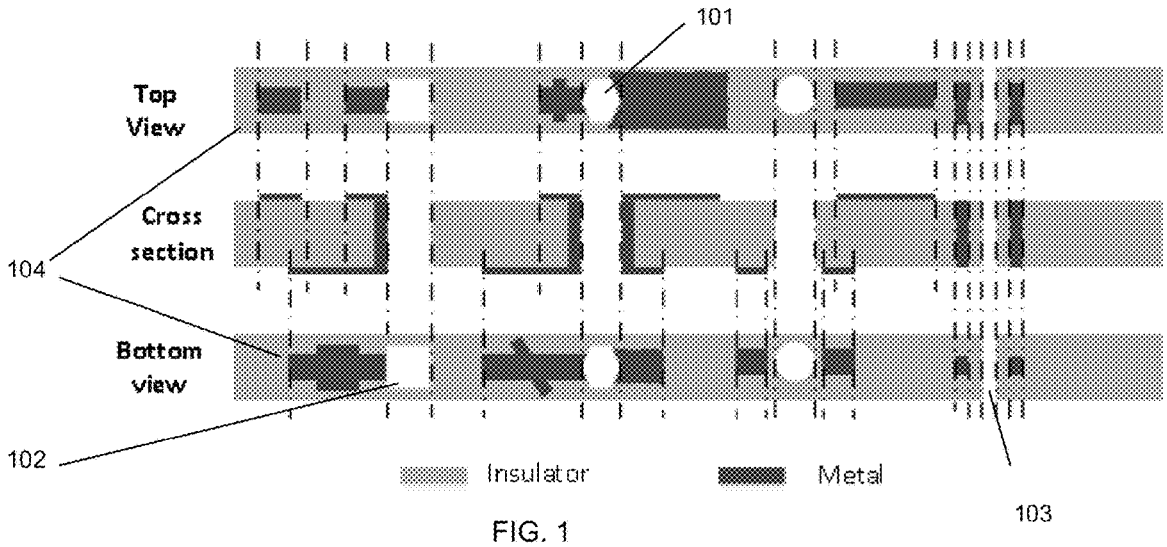
FIG. 1 schematically illustrates top, cross section, and bottom views of some structures used for implementation of ESQ and RF wafers including insulated holes, holes with sidewall metal coatings, holes with partial sidewall metal coatings, metal-filled vias, as well as top and bottom patterning for routing of electrical signals and contact to sidewall metals, or vias, according to exemplary aspects of the invention.

Different versions of ESQ and RF wafers with different performance vs ease of fabrication tradeoffs may require implementation of one or more of the following structures on an insulating substrate, some of which are illustrated in FIG. 1: through-holes with metal coated or insulating sidewalls 101; through-holes with partially metal coated or insulating sidewalls 102; through-holes with closely spaced metal vias (10 nm-200 μm) 103; top and bottom metals layers for electrical signal routing and contact to vias or sidewall metals of the through-holes 104.

In addition, the substrate should allow high-breakdown fields so that large voltages (>1 kV) can be applied across adjacent metal, via, and sidewall-metal structures to help with electrostatic focusing, guiding, or acceleration of charged particles. The metal thickness is chosen to minimize resistive losses at RF frequencies associated with direct resistance and skin effects. Aspect ratios, gaps, and thickness of the substrate will depend on the particular device and the choice of fabrication, each introducing potential cost and performance tradeoffs. We describe five (i-v) different fabrication approaches for the embodied RF and ESQ wafers.

Figure 2:
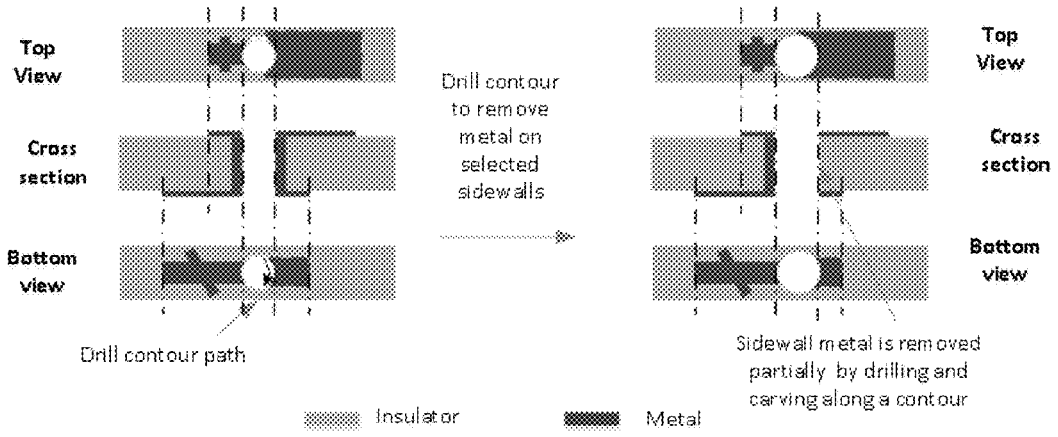
FIG. 2 schematically illustrates (left stack) a PCB built using methods known in the art and (right stack) fabrication of ESQ wafers using an additional drilling step to selectively remove metal on certain parts of the via as dictated by the drill contour path, according to an exemplary aspect of the invention.

(i) Fabrication of ESQ and RF Wafers Using PCB Machining and Contour Routing with a Drill Bit Two-sided printed circuit boards (PCB's) can be machined by a combination of drilling, contour routing, electroless plating, electroplating, lamination, photolithography, and etching, well known to those skilled in the art. In the embodied method, due to the inherent nature of electroless plating, all the sidewalls of vias are covered with metal, since regular PCBs used in electronics only require vias with all sidewalls metal-coated. However, ESQ wafers require removal of metal sidewalls in certain parts of the via. This may be realized by traversing a drill bit over a contour that overlaps with the boundary of the sidewalls over which metal needs to be removed. This process is summarized in FIG. 2, in which the left stack shows a PCB that can be built using methods known in the art; the right stack illustrating fabrication of ESQ wafers using an additional drilling step to selectively remove metal on certain parts of the via as dictated by the drill contour path. After the contour routing is done, part of the sidewall in the circular metal is free of metal, while part of it remains metallized.

(ii) Fabrication of ESQ and RF Wafers Using PCB Machining with Laser

Figure 3:
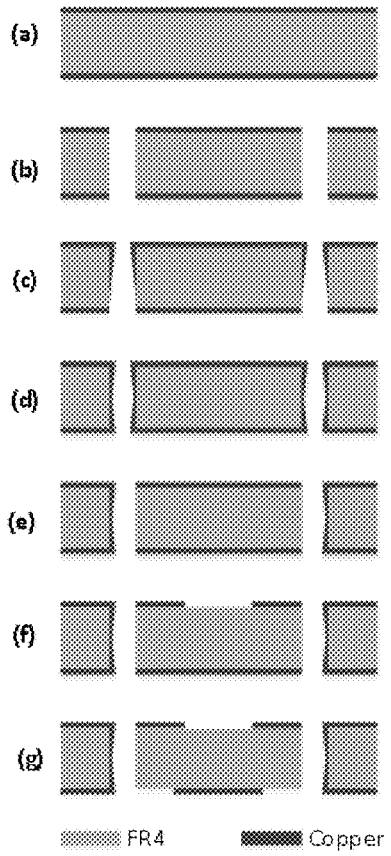
FIGS. 3A-3G schematically illustrate the process steps for fabricating ESQ wafers using PCB machining with a laser tool, according to an exemplary embodiment of the invention.

Compared to what is available from a standard two layer PCB fabrication process, there are additional requirements for ESQ and RF wafers. As RF wafers do not require sidewall metal coating, their fabrication process is simpler compared to the process for ESQ wafers. Since any process to fabricate an ESQ wafer can also be used to fabricate an RF wafer, we illustrate the fabrication steps for an ESQ wafer, which in general may require: (1) non-circular vias; and (2) partially metal-coated sidewalls. Both of these aspects can be accommodated using a laser cutter (e.g., LPKF ProtoLaser U, which removes copper or FR4 material by abrasion. Using laser micromachining, top and bottom metal layers can be patterned and holes can be made through the board. Alignment between top and bottom is achieved by using an integrated vision system and pre-fabricated alignment fiducials. Furthermore, by using the integrated camera of the tool, top and bottom layers can be registered for alignment. Main steps of an exemplary process to fabricate an ESQ wafer are illustrated in FIGS. 3A-3G. In this process, the starting FR4 based board (double clad, 0.028", 1 oz. FR4 board that is cut in the shape of a 4 inch wafer) has copper on both sides as seen on the top cross section in FIG. 3A. In FIG. 3B holes are cut into the PCB using the laser tool. As the holes in the PCB's are created using a scanned laser beam rather than a milling tool, arbitrary hole shapes can also be easily realized. For ESQ wafers only, after the definition of holes, metal (e.g., Cu) is evaporated in a conformal evaporator with a rotating chuck system on both sides (typically 1-2 μm; e.g., 500 nm), as per FIGS. 3C and 3D. The metal may be electroplated from both sides for better coverage of the sidewalls. In FIG. 3E the wafer is isolation cut with the laser to remove part of the sidewall over which no metal is desired (only for the ESQ process). In FIG. 3F the top metal layer is patterned using the laser after alignment with fiducials. In FIG. 3G the bottom metal is patterned after alignment with fiducials.

Figure 4:
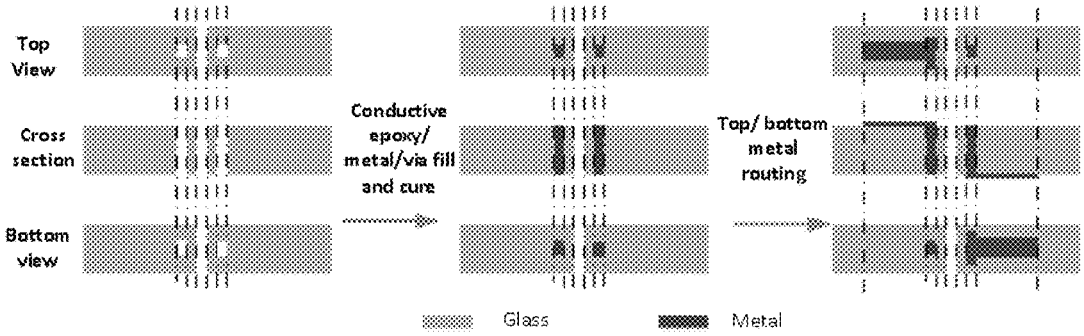
FIG. 4 schematically illustrates the process steps for fabricating ESQ wafers using glass micromachining, according to an exemplary aspect of the invention.

(iii) Fabrication of ESQ and RF Wafers Using Glass Micromachining and Through-Glass Vias Instead of FR4, glass may be used as the insulating substrate with Through-Glass-Vias (TGV). This allows fabrication on a low cost substrate with smaller features than what might be possible with PCB fabrication. Furthermore, high vacuum compatibility of glass and high breakdown voltages are advantageous. The basic steps of the process flow are illustrated in FIG. 4. First, arbitrary shaped through-holes are laser machined (left panel). Then parts of the holes that will form the vias are filled with a conductive slurry/epoxy through a stencil mask and cured (venter panel). Next, top and bottom metallizations are done for routing either through physical vapor deposition and/or electroplating (right panel).

(iv) Fabrication of ESQ and RF Wafers Using Silicon Micromachining

Figure 5:
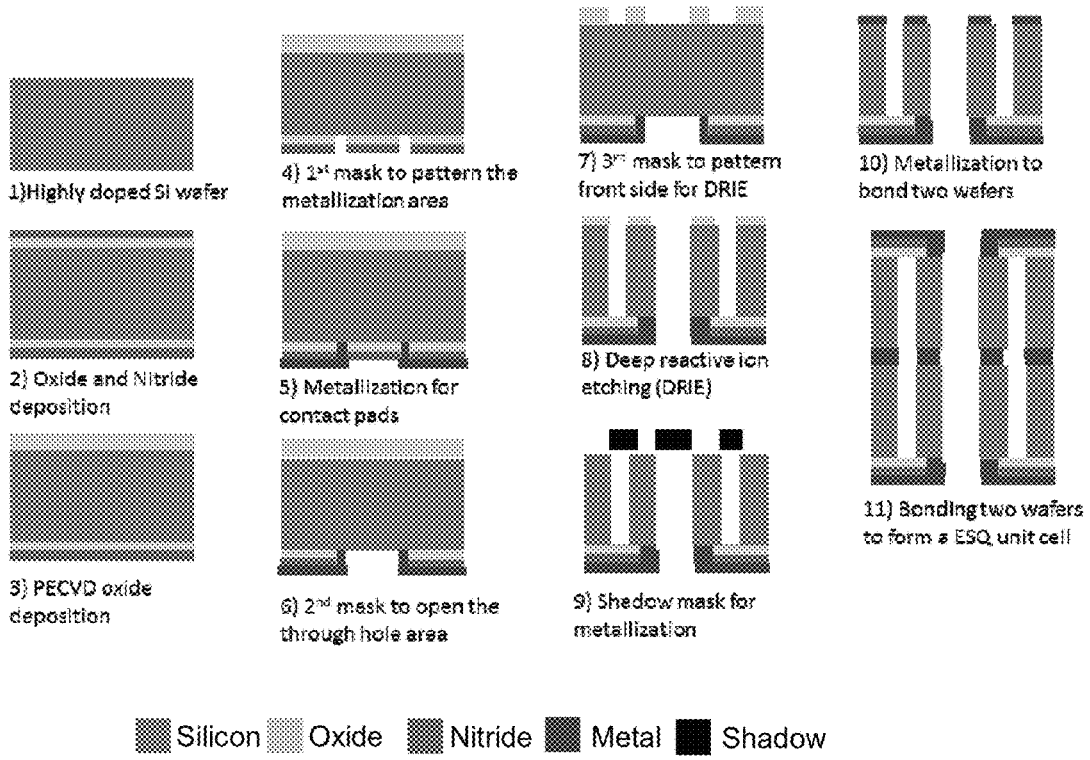
FIG. 5 (steps 1-11) schematically illustrate ESQ wafer assembly (i.e., two stacked ESQ wafers) fabrication process steps using a silicon wafer, according to an exemplary aspect of the invention.

FIG. 5 schematically illustrates ESQ (and RF acceleration structure) fabrication process steps (1-11) on a silicon wafer. Using this technique the fabrication of RF wafers is relatively simple, as they consist of arrays of through holes where each hole is surrounded by a ring of metal. For an ESQ wafer the fabrication process is started with highly doped silicon wafer (for example 100 mm, 4 in, resistivity=0.005–0.020 Ohm cm, thickness 490-510 μm). The doped silicon wafer is oxidized and coated with silicon nitride for electrical isolation. To supply the high voltages into the ESQ, the deposited oxide and nitride layers are patterned and a metal layer is deposited onto the electrode pillar regions (step 5). After forming metal contacts, the pillar structures are fabricated using Deep Reactive Ion Etching (DRIE) (step 8). Finally, to develop an ESQ unit cell, two wafers are bonded using an intermediate metal layer (step 11). These ESQ unit cells stand only on the oxide and nitride layers; hence, the electrical breakdown voltage of the oxide and nitride stack layer is an important parameter to determine the operating voltage of the ESQ unit cell. In an exemplary aspect, 1 μm oxide and 2 μm silicon nitride layers have been deposited and withstood a breakdown voltage of 3000 V (V=E×d, V=Breakdown voltage, E=Dielectric strength [$10^9$ V/m for both oxide and nitride] and d=3 μm, thickness [Oxide=1 μm and Nitride=2 μm]).

Figure 6:
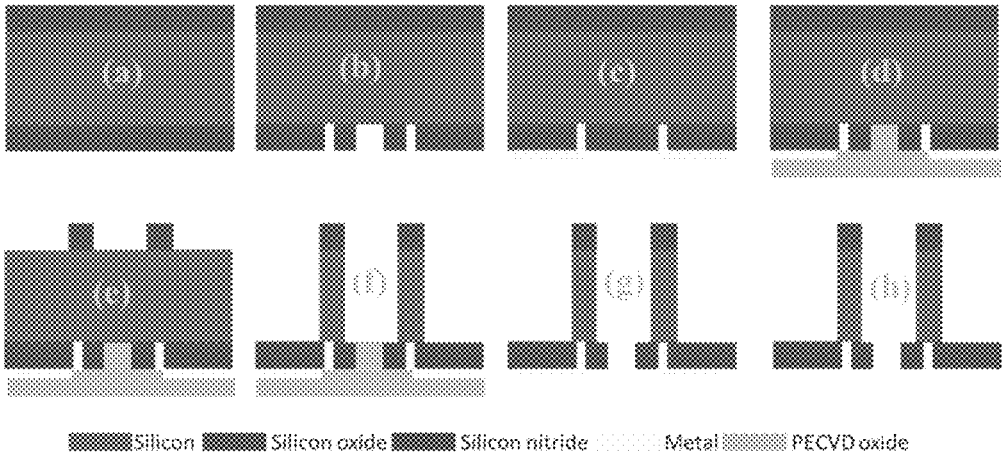
FIGS. 6A-6H (steps a-h) schematically illustrate a single ESQ wafer fabrication process, according to an exemplary aspect of the invention.

FIGS. 6A-6H (steps a-h) schematically illustrate a single ESQ wafer fabrication process, according to an exemplary aspect of the invention. FIG. 6A shows a LPCVD nitride and oxide coated highly doped silicon wafer; FIG. 6B: the oxide and nitride is patterned for metal deposition; FIG. 6C metal is selectively evaporated onto the patterned surface; FIG. 6D PECVD oxide on back side (stop layer for DRIE); FIG. 6E the front side oxide and nitride is patterned; FIG. 6F the front side is deep-reactive ion-etched (DRIE); FIG. 6G the PECVD oxide is removed to make a through-aperture; FIG. 6H wire bonding.

Figure 7:
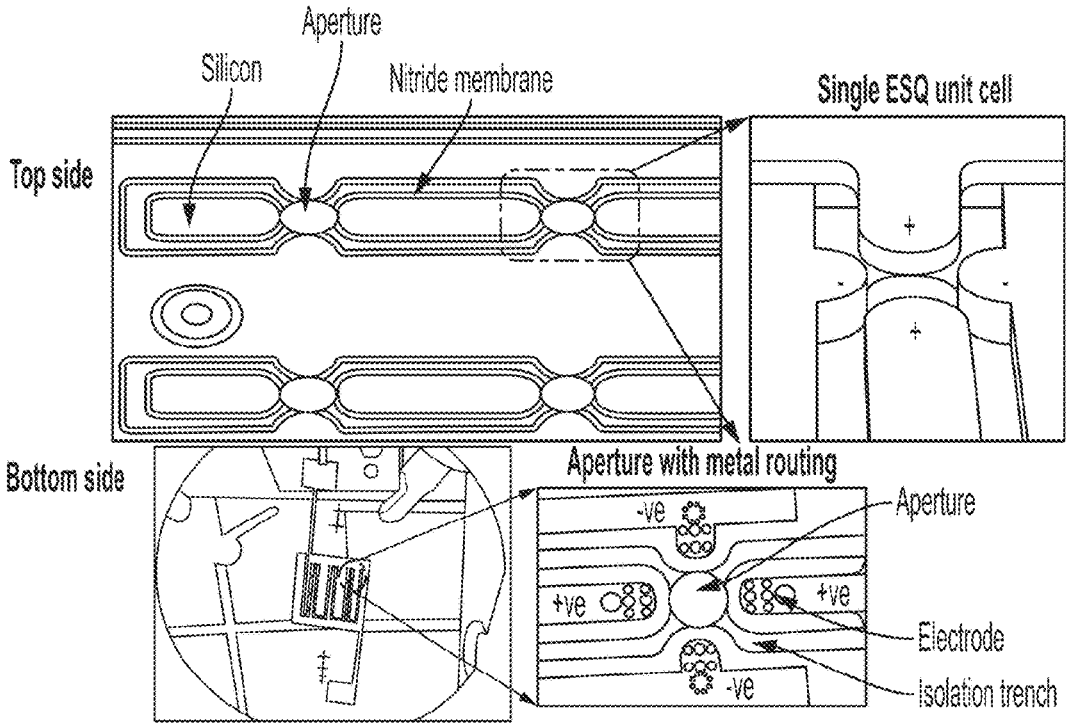
FIG. 7 pictorially shows different views and details of an ESQ wafer and a single ESQ unit cell, according to an exemplary aspect of the invention FIG. 8 schematically shows the overall architecture and unit cell structure of a MEMS based MEQALAC, according to an exemplary embodiment of the invention.

FIG. 7 pictorially shows different views and details of an ESQ wafer and a single ESQ unit cell, according to an exemplary aspect of the invention.

(v) Fabrication of ESQ and RF Wafers Using 3D Printing

ESQ wafers and RF wafers can also be fabricated by 3D printing. An advantage of 3D printing is the ability to form structures with small 3D features such as protrusions and holes in a low cost dielectric polymer substrate. In one implementation, the ESQ electrode diameter is 1 to 2 mm and the minimum feature size achievable in 3D printing is 50 to 100 μm. For ESQ structures, one implementation is to form two of the required four electrodes that constitute an ESQ in the polymer substrate on two separate wafers. The top surface of the polymer wafers is then coated with a few micron thick layer of, e.g., copper, which also coats the sides of the cylindrical ESQ electrodes. Two copper coated wafers with two ESQ electrodes of the same polarity per beamlet are then stacked together to form the finished ESQ wafer with the selected number of ESQs.

RF (or wafers that provide high voltage pulses) for ion acceleration consist of holes for beams to transverse and rings of metal electrodes on a dielectric substrate. The arrays for holes can also be formed by 3D printing. Metal electrodes can be formed by (local) metal coating of rings around the electrodes.

Figure 9A:
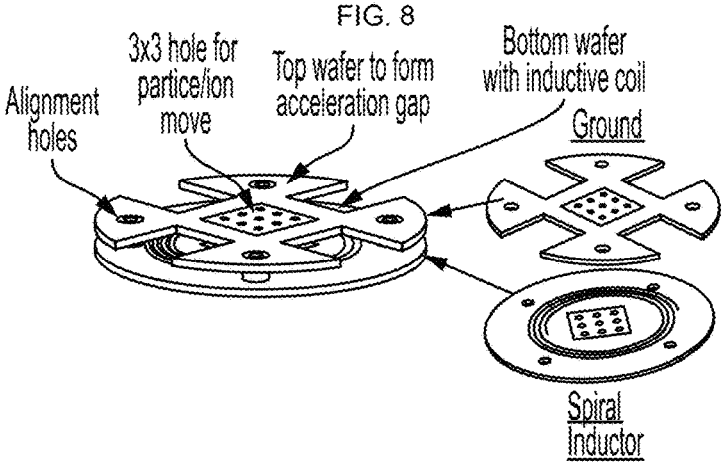
FIG. 9A schematically illustrates a 3D view of an inductor-capacitor (LC tank circuit) resonator design.
Figure 9A:
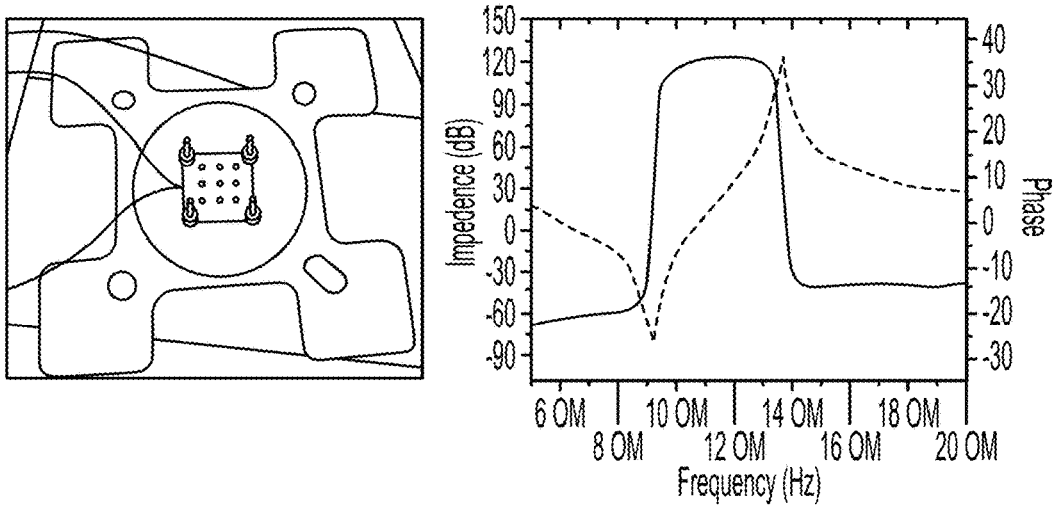
Figure 9B:
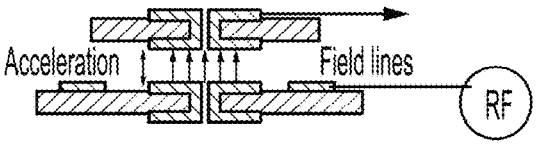
FIG. 9B a picture of the assembled fabricated LC resonator where the top PC-board electrode is attached to the bottom using insulating plastic bolts, where a bottom wafer can have a spiral inductor connected to the capacitor formed between the bottom wafer and the top ground wafer. The graph shows the resonance of the LC tank at about 12 MHz demonstrating quality factors of 20-30.
Figure 9C:
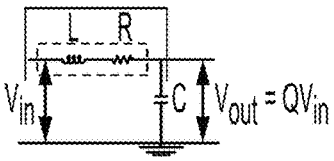
FIG. 9C shows the equivalent circuit of the LC tank demonstrating a passively increased voltage across the air gap, according to exemplary embodiments of the invention.

FIG. 9A schematically illustrates a 3D view of an inductor-capacitor (LC tank circuit) resonator design; FIG. 9B a picture of the assembled fabricated LC resonator where the top PC-board electrode is attached to the bottom using insulating plastic bolts, where a bottom wafer can have a spiral inductor connected to the capacitor formed between the bottom wafer and the top ground wafer. The top wafer can be affixed to the bottom wafer using insulating bolts. The graph shows the resonance of the LC tank at about 12 MHz demonstrating quality factors of 20-30. FIG. 9B shows the electric field lines from the bottom wafer to top wafer that can accelerate the charged particles. FIG. 9C shows the equivalent circuit of the LC tank demonstrating a passively increased voltage across the air gap, according to exemplary embodiments of the invention.

Figure 10:
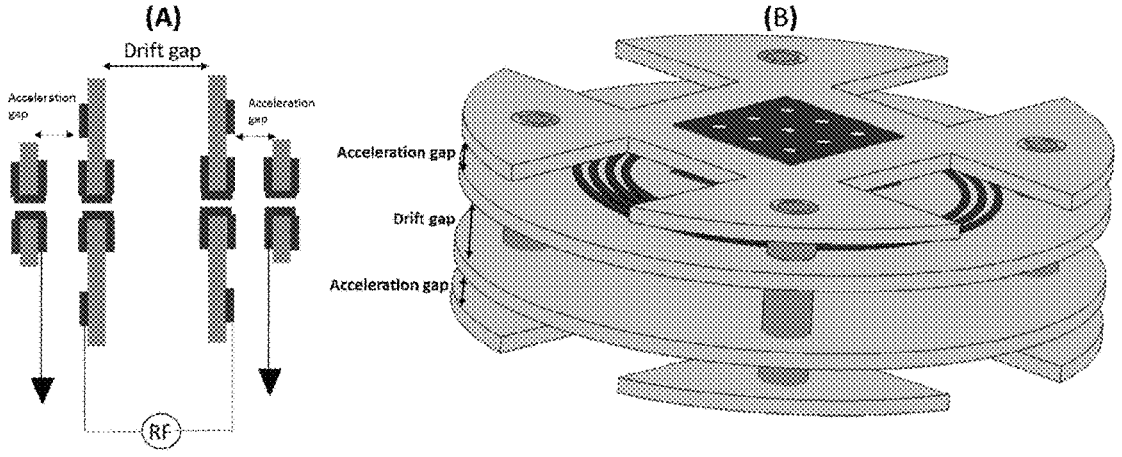
FIG. 10A schematically illustrates a 2D view of a single RF acceleration unit cell using four wafers.
FIG. 10B: a 3D view of the assembled single RF acceleration unit cell, according to an exemplary embodiment of the invention.

FIG. 10A schematically illustrates a 2D view of a single RF acceleration unit cell using four wafers; FIG. 10B a 3D view of the assembled single RF acceleration unit cell, according to an exemplary embodiment of the invention.

Figure 11A:
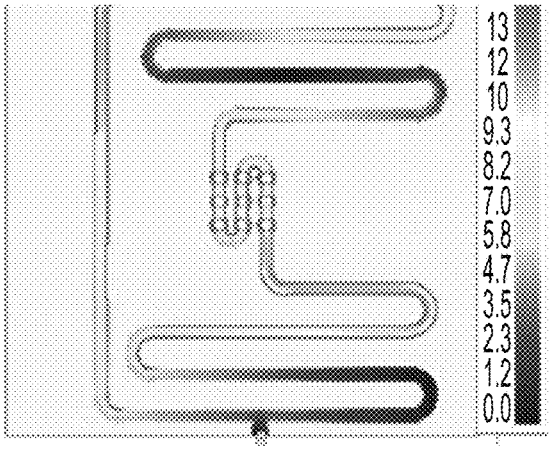
FIGS. 11A-11F: Coplanar waveguide resonator accelerator wafer.
Figure 11C:
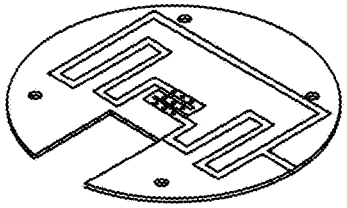
Figure 11B:
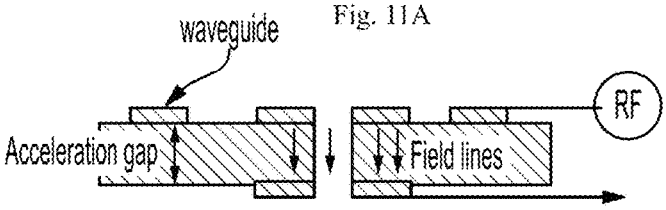
Figure 11D:
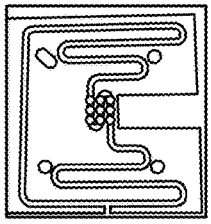
Figure 11E:
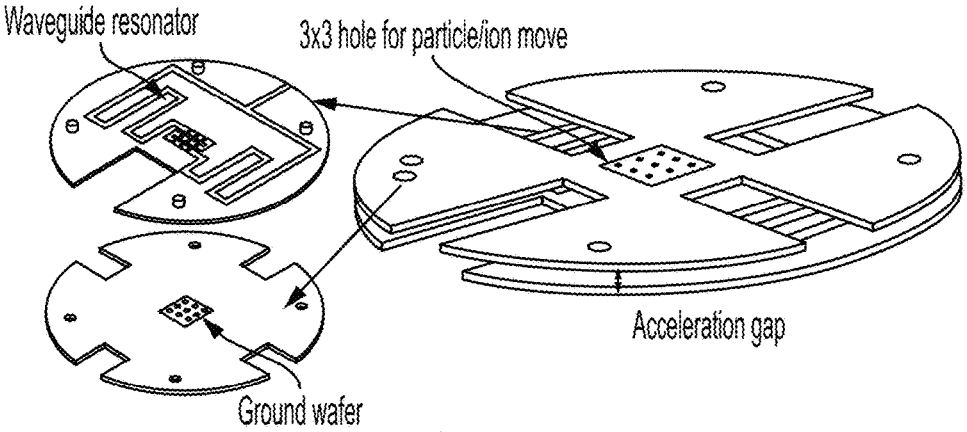
Figure 11F:
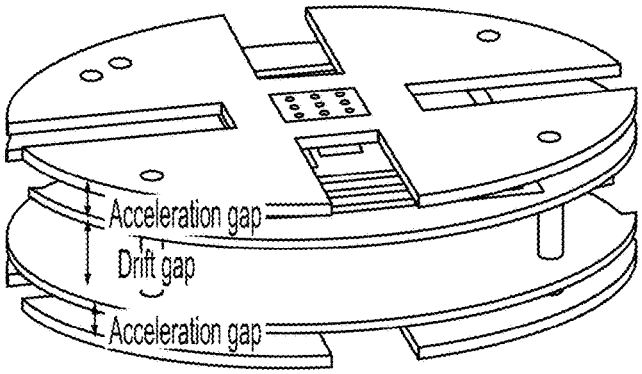

FIGS. 11A-11F illustrates a coplanar waveguide resonator accelerator wafer. In FIG. 11A a coplanar waveguide resonator is formed on the accelerator wafer with orifices for the charged particle beams to pass through, such that nodes and antinodes of the voltage provide passive voltage magnification. FIG. 11B shows that a single wafer provides the electrodes to accelerate particles through it nodes and antinodes of the CPS resonator. FIG. 11C shows the conceptual sketch of the CPW resonator. FIG. 11D shows the physical implementation of a CPW resonator for the accelerator wafer. FIG. 11E shows stacks of a CPW resonator and a ground wafer can also be used to form an accelerator section. FIG. 11F shows two accelerator structures stacked to form a complete accelerator sub-unit with ground potentials at input and output. One side of the wafer is grounded while the opposite side has a high voltage owing to the CPW resonance. Two such wafers are formed to form a drift space between the two wafers and the two active high voltages are in phase to not accelerate or deaccelerate in the drift space. The second wafer accelerates the beam again as the phase of the voltages have changed such as to provide an electric field in the desired direction of acceleration.

Based on the beam dynamics simulations with WARP3D and beam envelope codes, we have designed and are developing RF (radio-frequency)-acceleration wafers and ESQ (electrostatic quadrupole) wafers. We have tested ESQ and RF wafers and have achieved ion acceleration in a 3×3 beamlet array with a stack of RF wafers, accelerating argon ions (12 μA total current per beamlet) from 10 keV to about 11.7 keV. High voltages for incremental acceleration of charged particles can be provided by RF or by high voltage pulses (e.g., from power transistors).

Simulations of MEQALAC Structures

Figure 8:
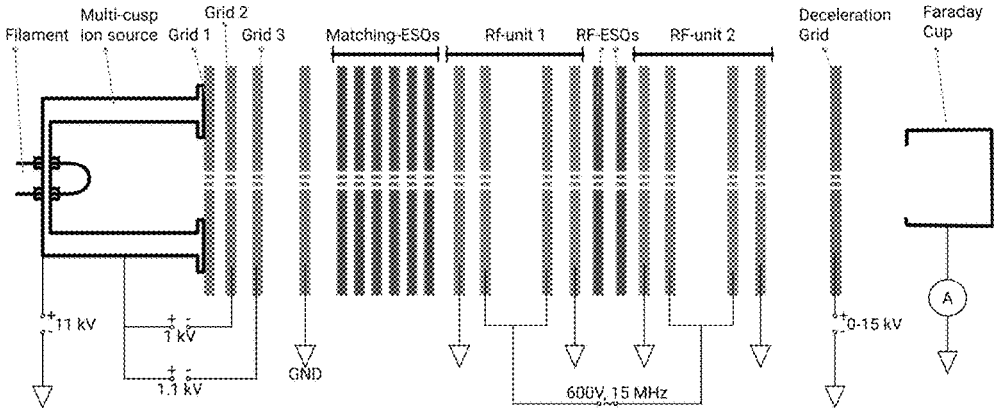

FIG. 8 shows a schematic of the overall architecture and unit cell structure of a MEMS wafer-based charged particle accelerator. It is constructed by stacking of ESQ and RF wafers and driving them by DC and RF voltages of appropriate phases, respectively. FIG. 8 also illustrates the multi-pixel structure of the wafers. The figure inset shows a 2×2 array of pixels each for a charged beamlet for simplicity. Microfabrication allows packing of a large number of pixels on a single wafer along with electronics and sensors to monitor the beam distribution and intensity.

Figure 12:
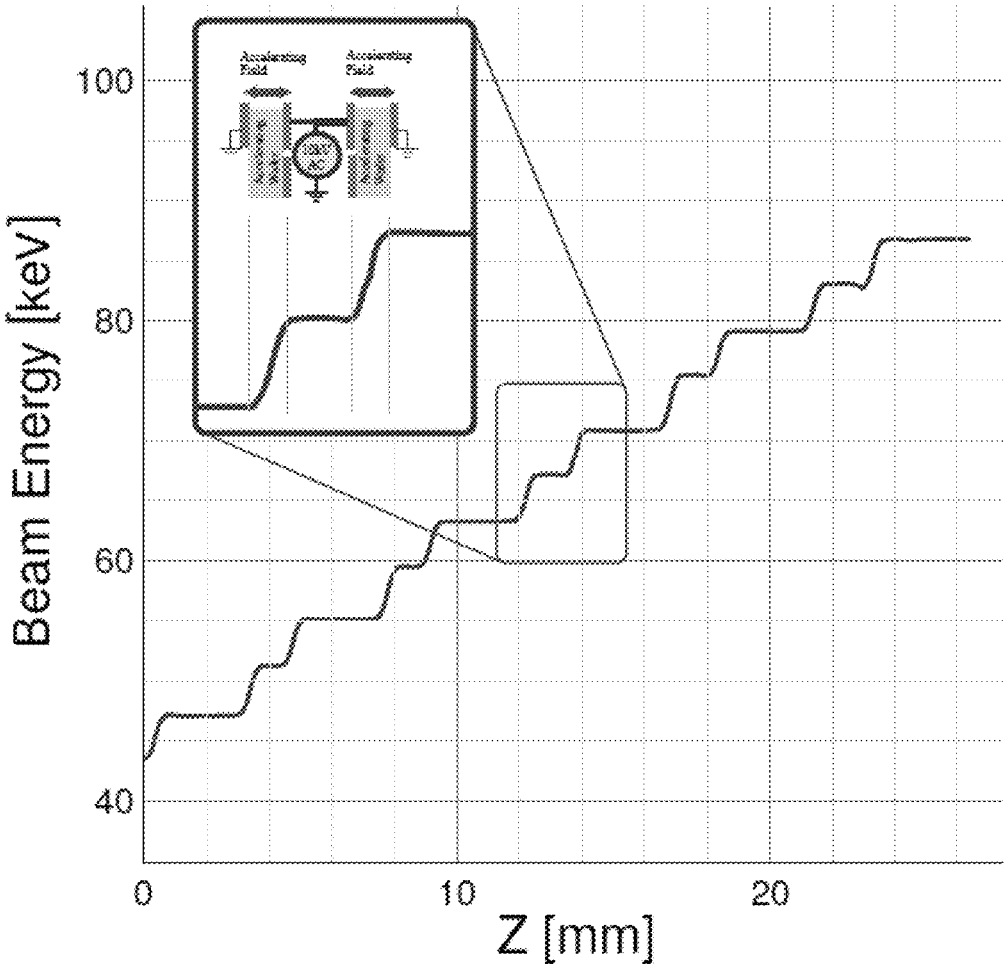
FIG. 12 schematically and graphically shows simulation results with xenon ion beam energy gain along a lattice of ESQs and 12 RF gap assemblies, according to an illustrative embodiment of the invention.

Our modeling run included six RF stages (i.e., 12 acceleration gaps) and ESQ doublets between each of the RF stages. We started with a matched injection condition that we had calculated with beam envelope codes (vs. particle-in-cell simulations with WARP, which are more computationally demanding). We calculated and optimized the phase offset and RF-gaps (RF-gap=$\beta\lambda/2$; where $\beta$ is the ratio of ion velocity divided by the speed of light and $\lambda$ is the RF wavelength). We also increased the ESQ value by 2% between each gap. The simulations are for xenon ions ($Xe^{1+}$), injected with 40 keV from an ion source, where a realistic beam emittance from our multi-cusp type plasma ion source is assumed. The current per beamlet is 20 μA, with a 40 μm beam radius in an aperture (or beamlet channel) with a radius of 90 μm. The simulations (FIG. 12) show acceleration from 40 keV to 87 keV over a distance of 28 cm, or 4.3 kV per RF gap, which is 86% of the applied RF peak voltage.

We tracked ion loss and found transmission of 85% of ions. Most losses occur right after injection and losses in later cells are below 1% per cell. Based on past experience with injecting and matching symmetric beams to an alternating gradient focusing lattice, we expect to significantly reduce the initial particle loss by tuning the strength of the first 4-6 electrostatic quadrupoles. Although the simulations were performed with xenon, first beam experiments are being conducted with argon, which is much lower in cost compared to xenon.

Figure 13:
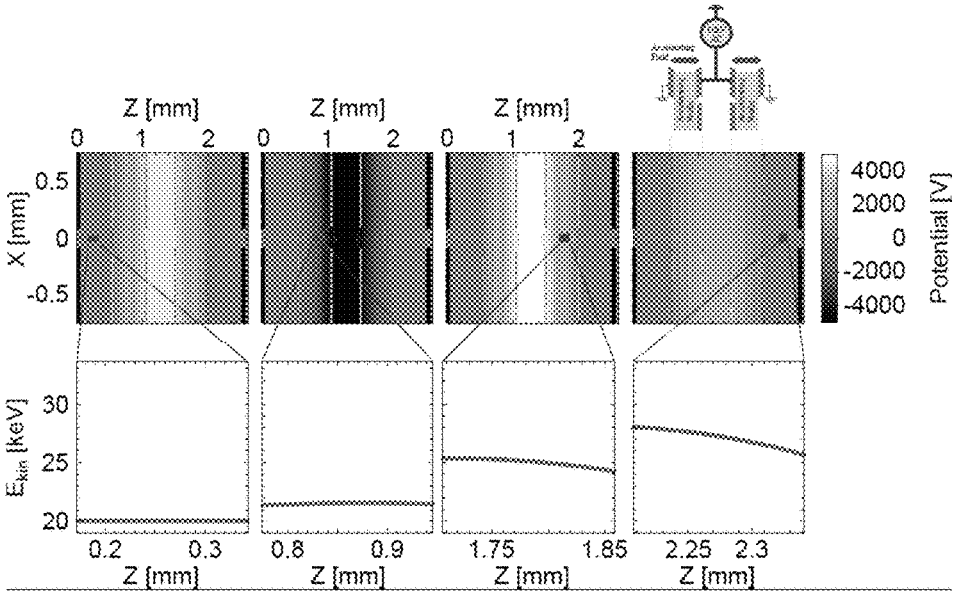
FIG. 13 schematically and graphically shows early simulations of ion acceleration in an RF gap assembly.

In earlier simulations of single gaps, illustrated in FIG. 13, ions move from left to right and the horizontal axis, Z (mm), is in mm. The vertical axis, X (mm), is also in mm and shows the dimension perpendicular to the beam propagation. On the right the RF voltage is shown in false color (the color scale is close to the vertical axis). In the bottom row, the kinetic energy of ions, $E_{kin}$, is shown expressed as beam potential in kV for a series of positions of the beam bunch in the RF structure. Ions are injected at 20 kV and gain energy as they enter (left to right) and then transmit the RF structure. Here, the horizontal scale is expanded in the four panels in the bottom row to highlight the change in ion energy along the RF structure. The main result shown is that in this geometry ions gain about 5 kV in two steps, when entering and then when exiting the RF gap.

The simulations also show that under these specific conditions we implemented an energy tilt on the ions in the bunch and this could be optimized for drift compression if desired.

Figure 14:
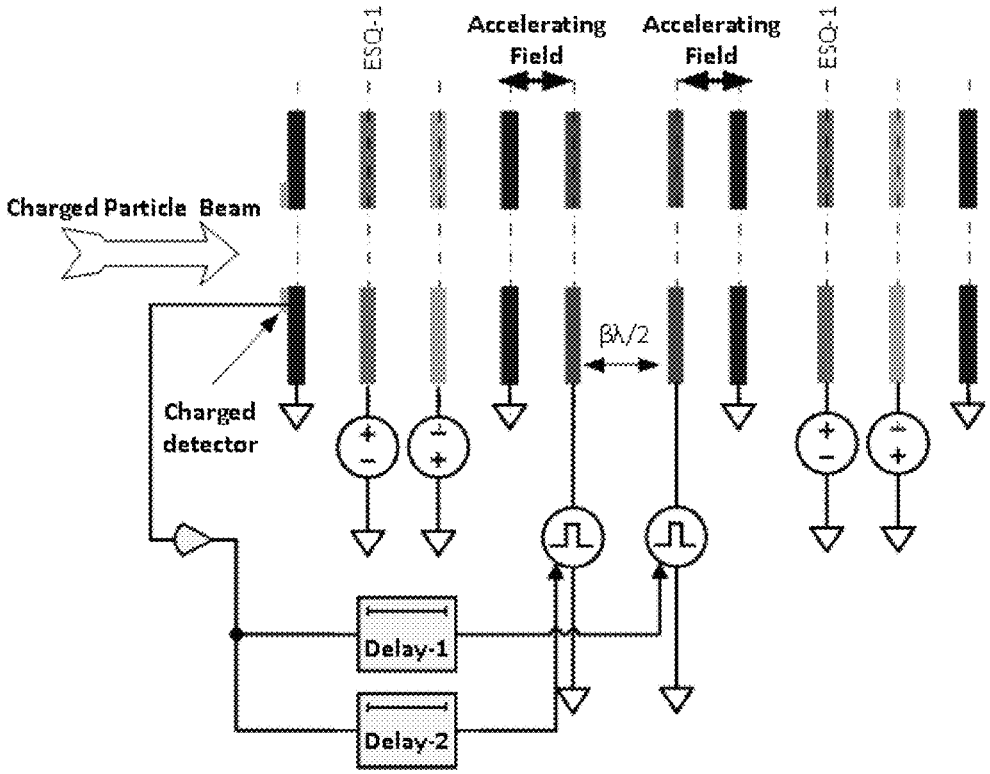
FIG. 14 schematically illustrates pulsed operation of the accelerator cell, according to an exemplary embodiment of the invention.

Continuous wave (RF) operation of the MEQALAC requires a large, external high voltage source. The accelerator can also be operated in pulsed mode. This approach requires feedback and relies on detection of the incoming beams and switching of accelerating voltages with electronically adjusted delays. This approach is illustrated in FIG. 14. As illustrated, the incoming beam is detected by charge monitoring systems, and is used to trigger the accelerating voltages after electronically adjusted delays so that the particles see accelerating voltages during their time in accelerating gaps. This approach offers the advantage that an external, high voltage source can be eliminated with necessary accelerating voltages supplied internally.

Operation of Accelerator Structures from the PCB Process

RF Acceleration

We assembled a stack of four RF wafers and mounted them in a vacuum chamber together with an ion source for first beam tests. We tested the multi-cusp plasma ion source and extracted about 26 μA of argon beam ($Ar^{1+}$) per beamlet from a 3×3 array of beamlets. In these first PCB beamlet structures, the beamlet diameter is of order 1 mm.

Figure 15A:
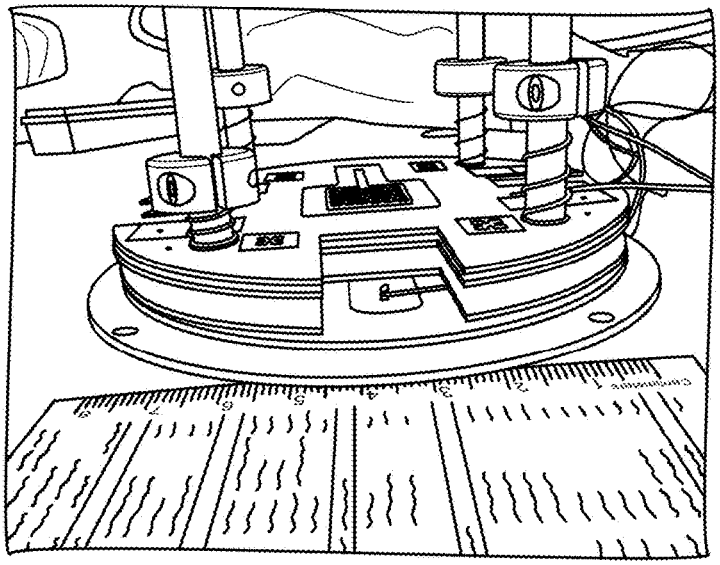
FIG. 15A is a photo of an assembled stack of four PCB based RF wafers for demonstrations of multi-beamlet transport and acceleration.
Figure 15B:
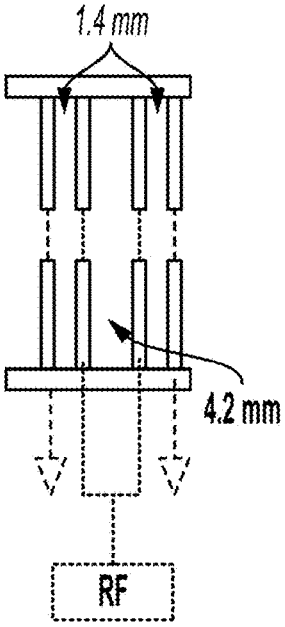
FIG. 15B is a schematic of an RF circuit for beam acceleration in the stack of four wafers.
Figure 15C:
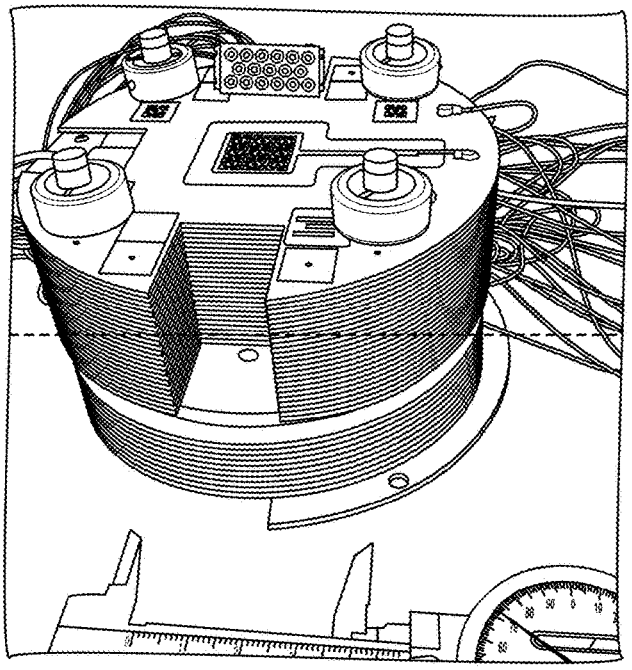
FIG. 15C is a photo of an assembled stack of six ESQ wafers (grey) that match the ion beam from an ion source into the accelerator structure and a series of four RF acceleration wafers as in FIG. 15B, two ESQ wafers and another four RF acceleration wafers, according to illustrative embodiments of the invention.
Figure 16:
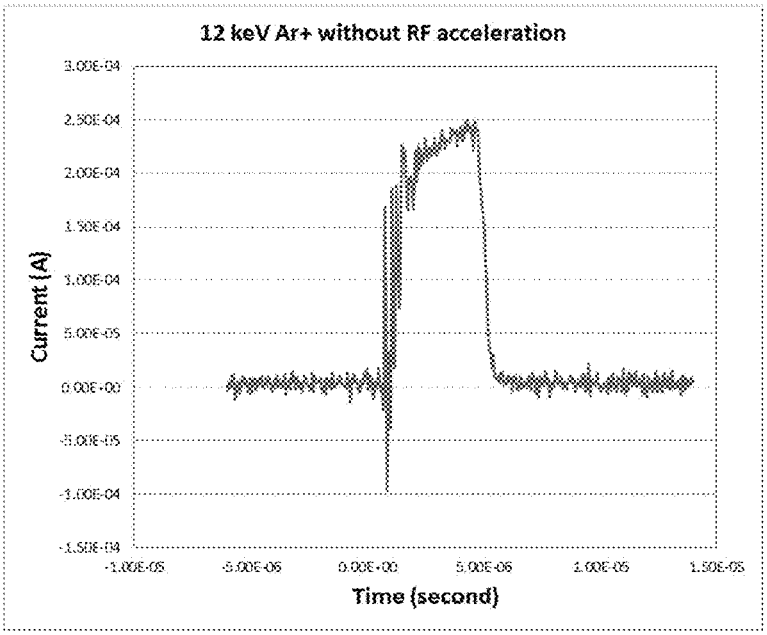

FIG. 15A shows the assembly of the four PCB RF wafers with 3×3 beamlet array through which the beam is transported. We applied RF HV pulses to demonstrate RF acceleration and observed an energy gain of about 1 to 2 kV. As illustrated in FIG. 15B, which schematically shows an RF circuit for beam acceleration in the stack of four wafers, ions are accelerated between the first wafer (at ground) and the second (at RF HV), ions then drift for a distance matched to $\beta\lambda/2$, then they are accelerated a second time between the RF biased wafer and the forth wafer at ground. FIG. 15C is a photo of an assembled stack of six ESQ wafers (grey) that match the ion beam from an ion source into the accelerator structure and a series of four RF acceleration wafers as in FIG. 15B, two ESQ wafers and another four RF acceleration wafers FIG. 16 shows a current trace of $Ar^{1+}$ ion current during a 4 us pulse where ions are transported through a 3×3 beamlet array in a stack of four RF wafers, but without RF voltage applied. The injection bias is 12 kV and the total beam current is 240 μA. A Faraday cup was mounted right after the RF wafer stack for current measurements. We have a broad range of control over the plasma on time and ion extraction pulse length.

Figure 17:
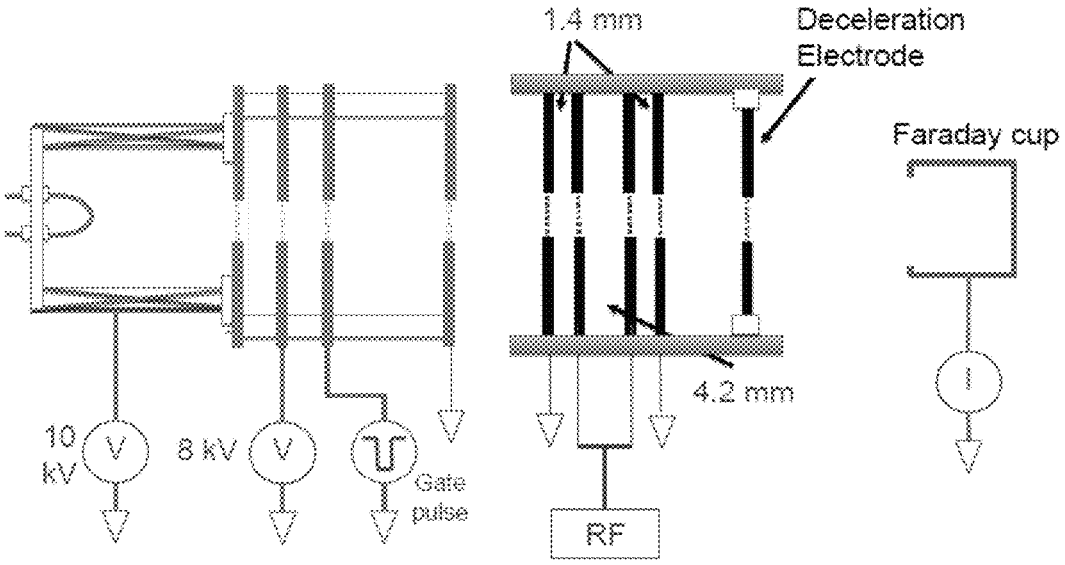
FIG. 17 schematically illustrates an RF wafer assembly for accelerating ions, according to an exemplary embodiment of the invention.

Using the setup shown in FIG. 17, pulses of argon ions were injected into the RF wafer assembly and ion acceleration was observed. A retarding field was applied to a high transmission grid to measure the ion beam kinetic energy. This was first run with the RF off and repeat voltage scans on the grid with varying RF power levels. We observed transport of ions that were accelerated by 0.7 kV (low RF power level) and up to 1.7 kV (high RF power level). RF HV is applied from an off-board tank circuit through a low capacitance cable to the wafer stack as shown in FIGS. 15A-15C.

The plasma ion source has a three grid extraction system. A floating grid, followed by a grid that is biased at −2 kV with respect to the source body. The following electrode is held at +1 kV when no ions are extracted and the potential is lowered to approx. −3 kV during extraction (also with respect to the source body). For the following runs, we biased the source at 10 kV. The RF wafer stack consists of four wafers. The first and last are grounded and the second and third are connected to the RF. We went with this layout, since a) the vacuum gap between wafer 1 and 2 and between 3 and 4 can hold higher voltages vs. the voltage across an RF wafer and b) RF losses in the FR4 are no concern in this configuration. The RF-stack is followed by a mesh that we can bias to high voltage. We use this as an energy filter, e.g., if the voltage RF sub-assemblies is higher than the beam potential, no ions will pass the mesh. This way we can test if our beam has been accelerated by the RF. The mesh will also have a focusing or de-focusing effect.

Figure 18:
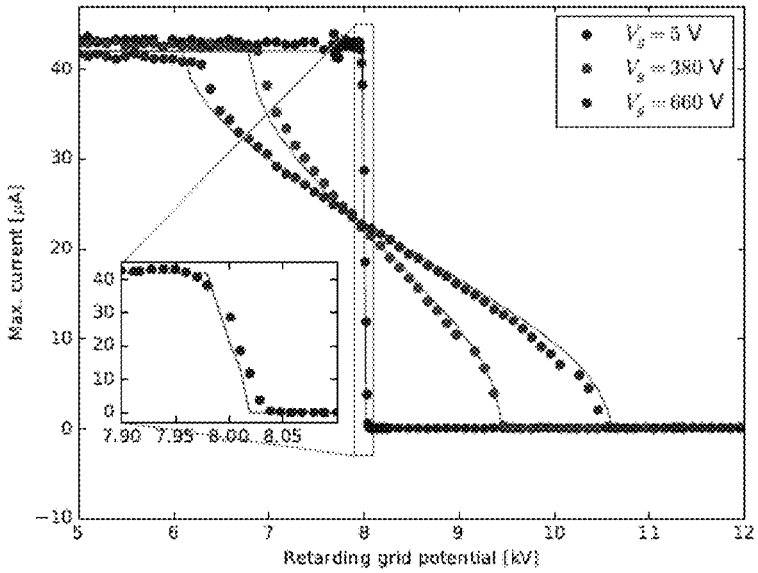
FIG. 18 graphically shows a plot of ion currents vs. retarding field for a series of RF power conditions.

We extract the beam from the source at 10 kV and send the beam through the RF wafer stack (two RF acceleration gaps). The beam then passes through an energy filter (positive biased mesh) and is captured by a Faraday-cup. We measure the beam energy by scanning the mesh voltage and see when the current drops to zero. We repeat this with the RF amplitude set to different levels and test different frequencies. We clearly see that the beam gets accelerated by up to 1 kV; e.g., the drop-off moves from 10.5 kV to 11.5 kV (FIG. 18). This was a proof-of-concept demonstration of multi-beamlet RF acceleration in a PCB wafer platform.

FIG. 18 shows a plot of ion currents vs. retarding field for a series of RF power conditions. The argon ion beam in a 3×3 beamlet array was injected at 10 kV and the highest observed RF acceleration was 1.78 kV.

We see that for the RF data, the beam charge vs. mesh voltage drops off at higher voltages, showing that the beam gained energy in the RF structure. We can also see that the energy spread of the beam increased during RF acceleration, which is to be expected, since we entered the RF structure with a 4 μs long beam pulse, which corresponds to about 80 RF oscillations at ~20 MHz. The energy gain can still be optimized, since in our current setup the frequency is not optimized for the fixed RF-gap between RF-wafers 2 and 3. Therefore, the second RF-acceleration gap might have had the wrong phase. Also, the ion source and extraction was not yet fully optimized for these runs, so ion currents can be further increased.

ESQ Focusing

Figure 19:
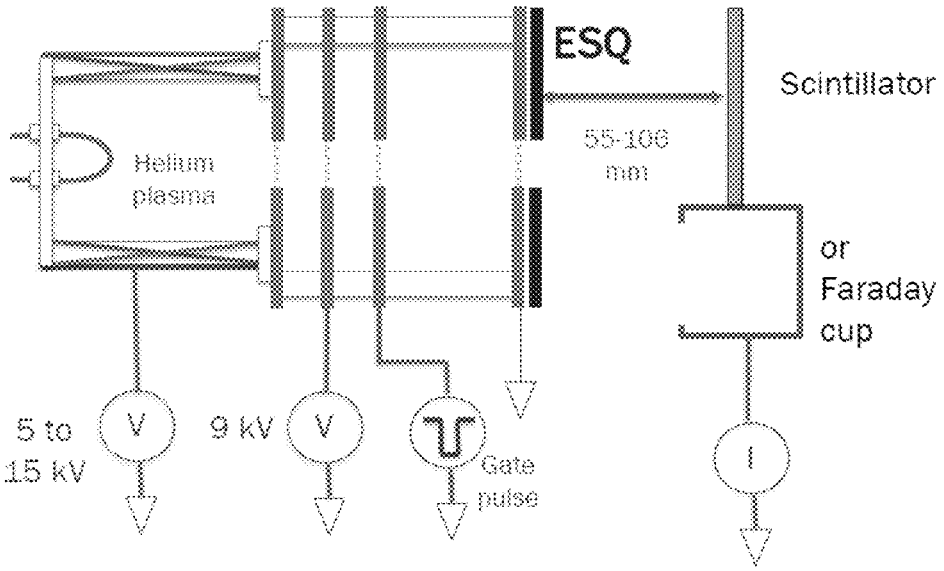
FIG. 19 schematically illustrates an ESQ wafer assembly for focusing ions, according to an exemplary embodiment of the invention.

We have achieved first ESQ operation with focusing of 5 keV $He^+$ beamlets (~10 μA/beamlet). We used $He^+$ to increase light output from the scintillator. We operated at ±100 V ESQ bias. FIG. 19 is a schematic of the setup with ion source, ESQ wafer, scintillator for beam profile measurements with a gated and image intensified camera and Faraday cup for current measurements.

For the first ESQ beam tests we chose to operate with helium ions at 5 keV. The lighter helium ions produce a proportionally higher light out-put in the plastic scintillator. The multi-cusp ion source can produce well in excess of 80 $mA/cm^2$ $He^+$ ions when driven to high discharge power. For heavier ions the current density decreases and we expect to be able to extract ~10 $mA/cm^2$ of xenon ions from this type of ion source. This translates into 100 μA to 800 μA for $Xe^+$ and $He^+$ ions, respectively, that we can inject into 1 $mm^2$ beamlets. We will determine limits on transportable current in our ESQ lattice and compare measurements with calculated limits (e.g. following the analysis by A. Maschke). For the current ESQ tests, we injected at a modest current density of 10 μA per beamlet, which is adequate for testing of ESQ focusing and RF acceleration.

Figure 20:
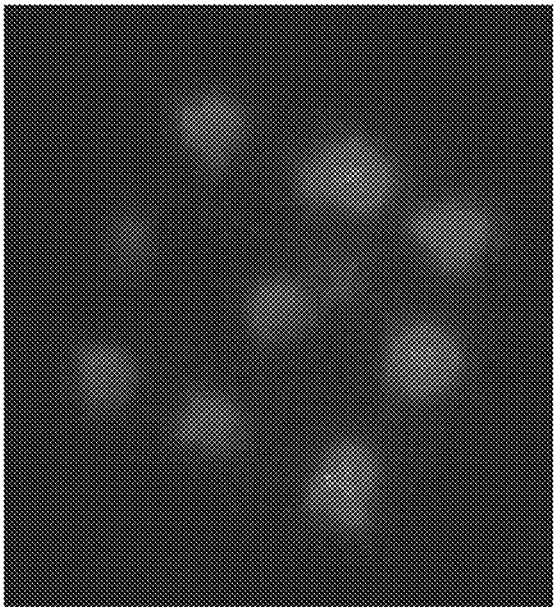
FIG. 20: Camera image showing nine beamlet apertures, we see light emitted from a scintillator following pulsed ion beam impact.
Figure 21:
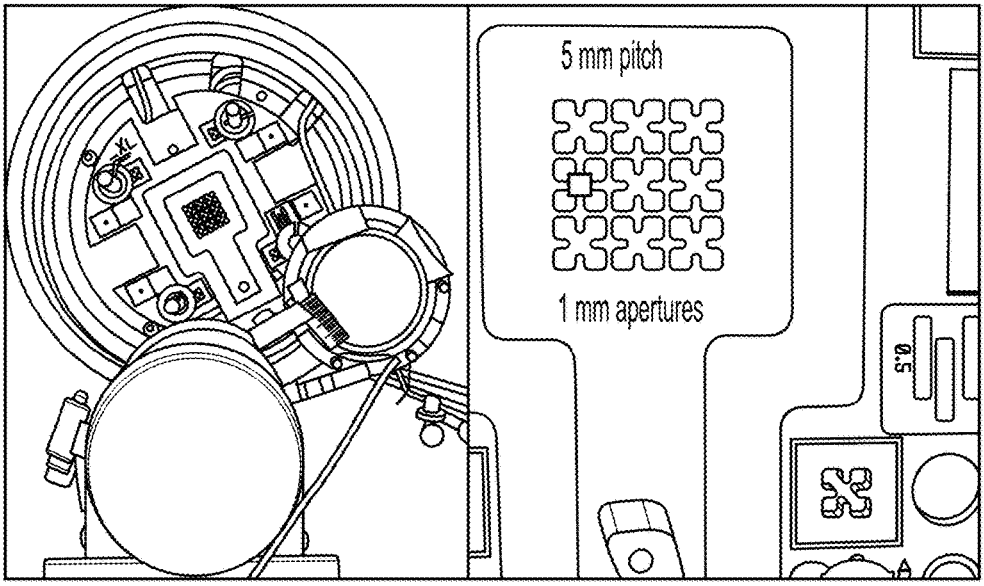
FIG. 21 shows photos of the mounted ESQ wafer and the 3×3 beamlet pattern fabricated using a PC board process.

We image the beam induced pattern of emitted light from the scintillator with a gated camera. In the first experiments we also observed background light from the ion source filament. FIG. 20 (Left) shows camera image showing six beamlet apertures. Detected light is dominated by background from the ion source filament which was in line of sight. FIG. 20 (Right) shows that after background subtraction we see light emitted following pulsed helium beam impact (from 1 ms pulses). This background light was most intense from three of the 9 holes in our 3×3 array (FIG. 21) and we mechanically masked these for the measurements we report here. We can eliminate this background using better bandpass filters, modified camera positioning, etc.

Figure 22:
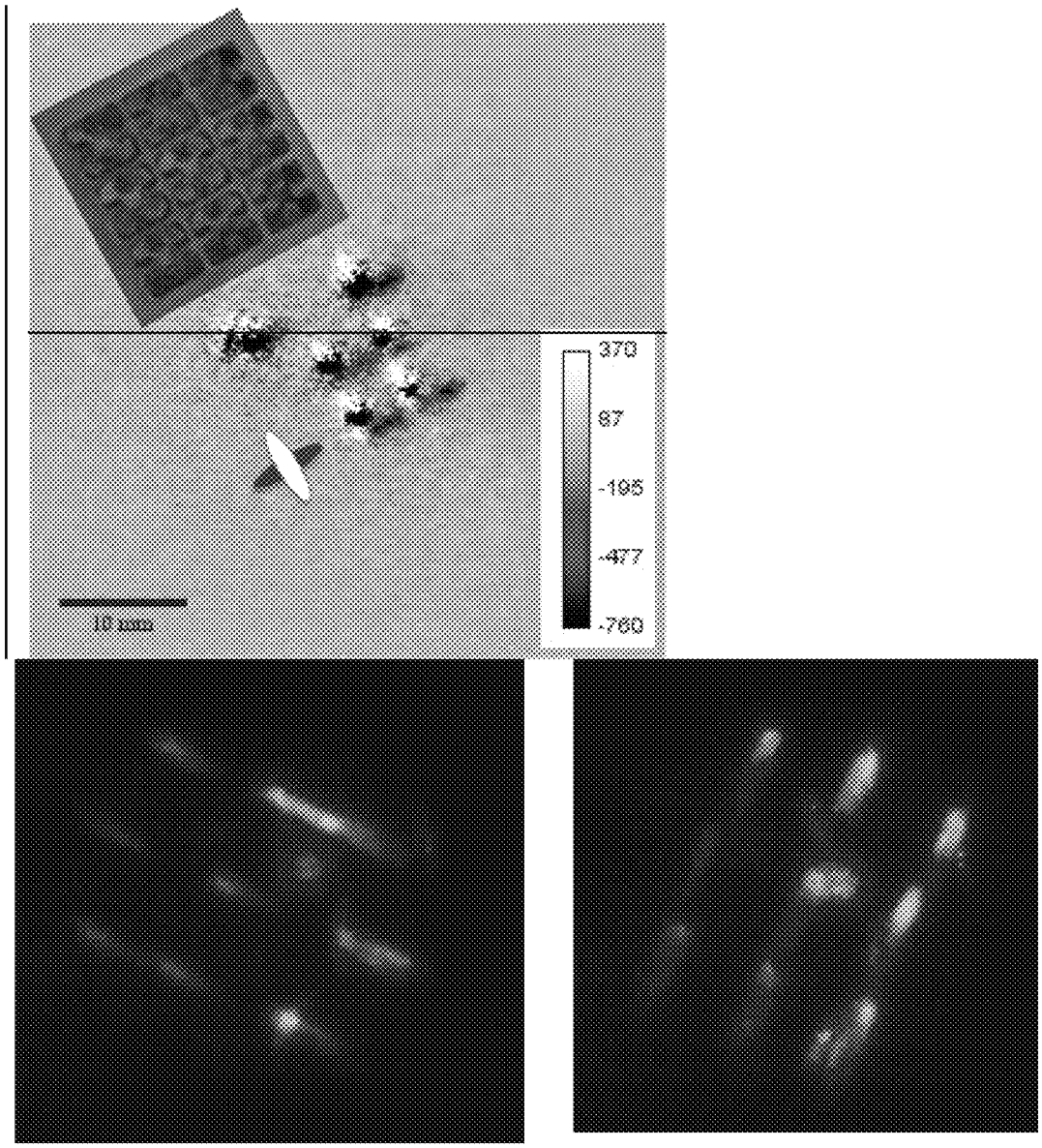
FIG. 22 top: shows a photo of the beamlet pattern in the ESQ (top left insert) and overlay of focusing patterns from application of +100 V and then −100 V. The expected pattern from ideal ESQs and envelope calculations of our geometry and bias conditions is a cross of two ellipses; bottom: images of beamlet patterns for a 3×3 array of beamlets for two ESQ voltages showing focusing in two perpendicular directions.
Figure 23:
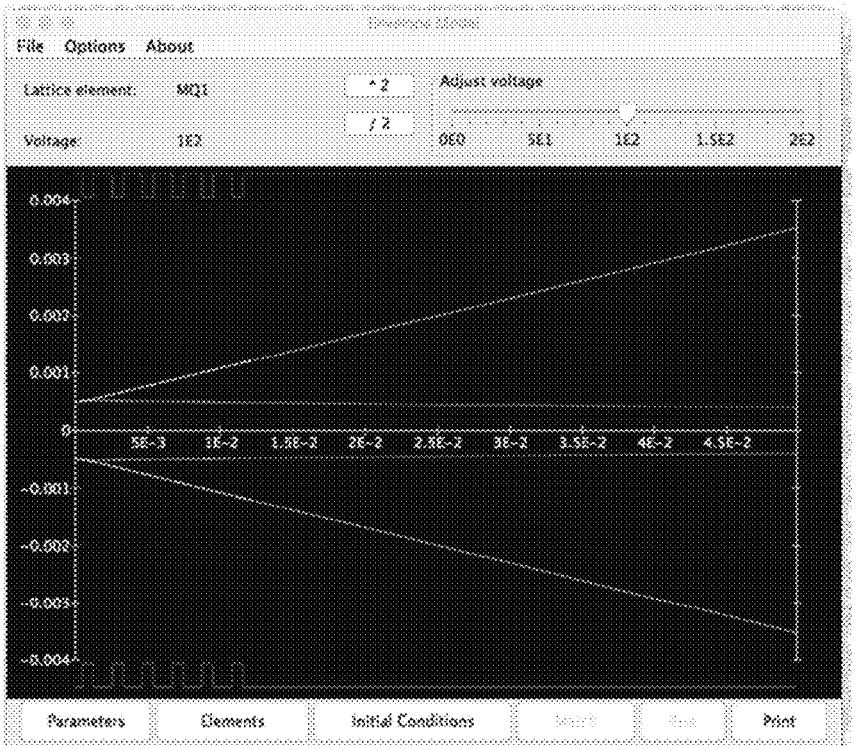
FIG. 23 shows an example of envelope calculations of expected ESQ focusing. For an ESQ bias of ±100 V the initially round beamlets are focused to ellipses.

FIG. 22 shows a photo of the typical elliptical deformation of a round beam that is the result of focusing the beam in one direction and at the same time defocusing the beam in the other direction from applying different polarities to the ESQ electrodes. Combining two ESQs into a doublet then allows the beam to be focused in both directions. We show an example of envelope calculations in FIG. 23. For an ESQ bias of ±100 V the initially round beamlets are focused to ellipses. Here, we initialized the calculations with beam conditions form the scintillator measurements.

Figure 24:
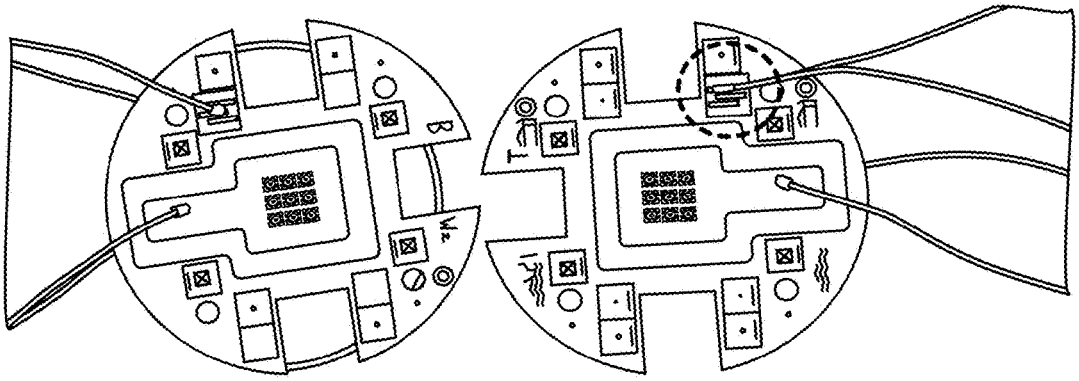
FIG. 24 show examples where the leakage currents across ESQs and across the PCBs was very low due to improved surface treatment after laser processing and fabrication of ESQ structures.

We have tested the HV holding capability of ESQ wafers based on PCB. In FIG. 24, we show examples where the leakage currents across ESQs and across the PCBs was very low due to improved surface treatment after laser processing and fabrication of ESQ structures. This is important for ESQ operation and we can apply voltages up to 1 kV (resulting in electrical fields ~10 kV/cm), which exceeds the design goals for efficient ESQ focusing with our geometry and ion beam energies.

We claim:

1. A wafer-based charged particle accelerator, comprising:
- a charged particle source;
- at least one RF charged particle accelerator wafer sub-assembly comprising:
  - a wafer having electrical isolation between at least a first and a second electrically conductive electrode,
- wherein at least the first and the second electrode are disposed on respective and opposing first and second sides of the wafer, and create an electric field,
- further wherein the wafer has one or more orifices through which a charged particle beam can travel, encountering the electric field generated by the at least first and second electrode,
- further wherein the second electrode is in the form of an RF resonator configured as either
  - a) a thin film inductor in series with an air gap capacitor, or
  - b) a coplanar waveguide resonator,
- so as to transform a low voltage on the substrate to a high voltage on the second side of the substrate; and
  - RF voltage-generating electronics disposed on the substrate; and
- a power supply operatively coupled to the at least one RF charged particle accelerator wafer sub-assembly.

2. The wafer-based charged particle accelerator of claim 1, further comprising a beam current-sensor disposed in either
- a) a single RF wafer, or
- b) a separate wafer disposed in the drift space.

3. The wafer-based charged particle accelerator of claim 1, further comprising:

at least a second RF charged particle accelerator wafer sub-assembly; and at least one ESQ charged particle focusing wafer.

4. The wafer-based charged particle accelerator of claim 3, wherein the at least one ESQ charged particle focusing wafer comprises an electrically insulative wafer or planar substrate having at least one through-hole, each through-hole providing a beam path to focus the charged particle beam, each through-hole having at least four electrodes disposed at the inner perimeter of the through-hole, where each electrode further comprises one of a) exposed areas of the wafer covered by a conductive material in selected areas to form an electric field distribution to focus the charged particle beam, and b) conductive pillar-like structures coupled to insulating connectors, connected to the wafer, linearly aligned with the RF charged particle accelerator wafer sub-assemblies.

5. The wafer-based charged particle accelerator of claim 4, wherein the conductive pillar-like structures are each one of a solid rod or a hollow cylinder.

* * * * *